US006244455B1

(12) United States Patent
Lastik

(10) Patent No.: US 6,244,455 B1
(45) Date of Patent: Jun. 12, 2001

(54) EASY OPENING CLOSURE MEMBER ASSEMBLY FOR A BEVERAGE CONTAINER

(76) Inventor: Joseph P. Lastik, 2408 Brownfield Dr., Greensburg, PA (US) 15601

( * ) Notice: Subject to any disclaimer, the term of this patent is extended or adjusted under 35 U.S.C. 154(b) by 0 days.

(21) Appl. No.: 09/480,829

(22) Filed: Jan. 10, 2000

Related U.S. Application Data

(63) Continuation-in-part of application No. 09/062,635, filed on Apr. 17, 1998, now abandoned.

(51) Int. Cl.[7] ..... B65D 17/32

(52) U.S. Cl. ..... 220/254; 220/268; 220/270; 220/359.2; 220/359.4

(58) Field of Search ..... 220/265, 268–270, 220/283, 825, 833, 254, 259, 258, 257, 359.1, 359.2, 359.4, 703, 711–715; 222/508, 541.5, 541.6, 541.9; 229/123.3, 123.1, 229, 906.1, 924, 925

(56) References Cited

U.S. PATENT DOCUMENTS

| | | | |
|---|---|---|---|
| 3,245,576 | 4/1966 | Griese, Jr. . | |
| 3,334,775 | 8/1967 | Klein et al. . | |
| 3,687,352 | 8/1972 | Kalajian . | |
| 3,711,011 | 1/1973 | Kugler . | |
| 3,843,011 | 10/1974 | Perry . | |
| 3,952,914 | 4/1976 | Vogt . | |
| 3,977,578 | 8/1976 | Perry . | |
| 4,065,025 | 12/1977 | Potts . | |
| 4,078,694 | 3/1978 | Gnyp et al. . | |
| 4,122,971 | 10/1978 | Potts . | |
| 4,136,797 | 1/1979 | Potts . | |
| 4,156,493 | 5/1979 | Julius . | |
| 4,215,791 | 8/1980 | Brochman . | |
| 4,410,101 | 10/1983 | Vogt . | |
| 4,493,431 * | 1/1985 | Cho | 220/257 |
| 4,553,684 | 11/1985 | Bennett . | |
| 4,632,299 | 12/1986 | Holmberg . | |
| 4,784,283 | 11/1988 | Cantu . | |
| 4,880,137 | 11/1989 | Wells . | |

* cited by examiner

*Primary Examiner*—Nathan J. Newhouse
(74) *Attorney, Agent, or Firm*—Webb Ziesenheim Logsdon Orkin & Hanson, P.C.

(57) ABSTRACT

An easy-opening closure member for a beverage or other container having a selectively openable tab defined in an end wall of the container with a predetermined separation or space formed therebetween. A hinge connects the end wall and the tab. A tape seals the undersurface of the end wall of the beverage container to the tab before opening. After opening the container by slight finger pressure, the tape adheres to the tab and separates from the end wall. A fingernail slot or other opening may be located on the tab.

19 Claims, 4 Drawing Sheets

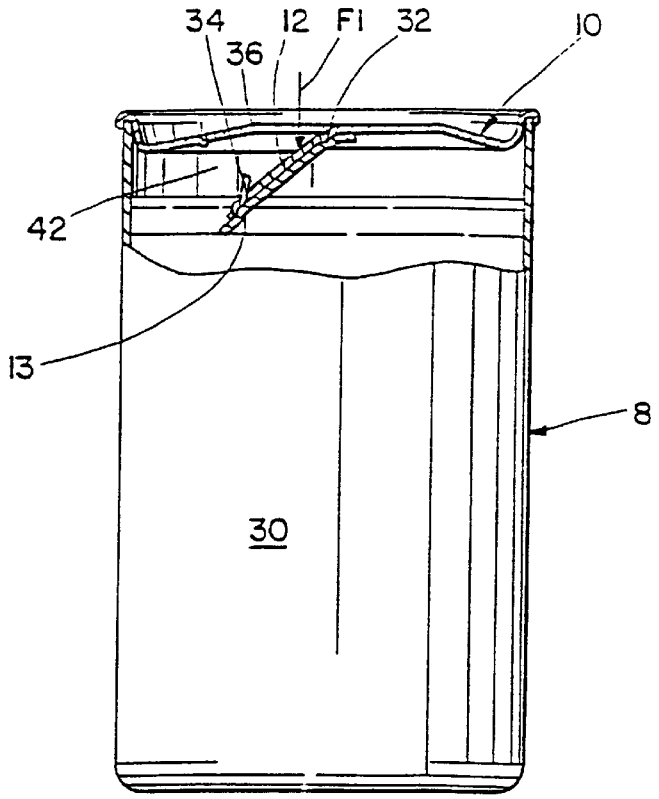
Fig. 5
Fig. 6
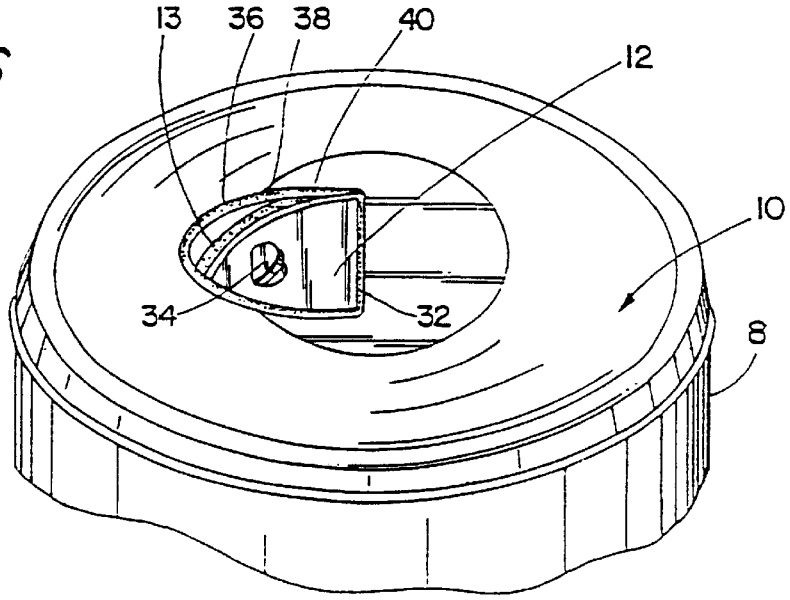

EASY OPENING CLOSURE MEMBER ASSEMBLY FOR A BEVERAGE CONTAINER

This is a continuation-in-part of U.S. application Ser. No. 09/062,635 entitled "Easy Opening Closure Member Assembly For A Beverage Container" filed Apr. 17, 1998, now abandoned.

BACKGROUND OF THE INVENTION

1. Field of the Invention

This invention relates to a container structure, more specifically to an easy-opening top closure for a beverage container, especially for soda pop containers or beer containers.

2. Background Information

Previously, the conventional pop-top beverage container comprised a disposable tear tab that was detached from the top of the container creating an opening for the consumption of the contents of the container. The removable tear tabs typically had sharp or rough metal edges and when separated from the top closure member, created litter when it was dropped on the ground creating unsightly and potentially hazardous situations.

More recent containers having easy-open top closure members comprise rivet tabs which again typically have sharp or rough metal edges which are pushed or pried open with a finger so that the edge of the tab is forced downward and inward into the can. Further, with either of the above type designs, the can, once opened, cannot be partially closed.

U.S. Pat. No. 4,078,694 to Gnyp et al. ("the Gnyp patent") is directed to a container closure. The Gnyp patent discloses a container closure which includes a container end wall having an opening therethrough, a tab pivotably attached to the end wall, a hinge pivotably connecting the tab to the end wall and a sealing strip membrane beneath the tab to seal the opening. The Gnyp patent teaches that the sealing strip is designed to be ruptured by the tab with a pointed tip. The Gnyp patent also teaches that the sealing strip should be scored to assist in the tearing or rupturing of the sealing strip. These features increase the cost of manufacturing this design. Additionally, tearing of the sealing strip increases the likelihood of introducing debris into the interior of the container as a result of the tearing action.

U.S. Pat. No. 3,952,914 to Vogt ("the Vogt patent") is similar to the Gnyp patent above. The Vogt patent discloses a container closure which includes a container end wall having an opening therethrough and a separate rubber or plastic seal pivotably sealing the opening of the end wall. The Vogt patent teaches that the sealing member be a rubber or plastic piece which seals due to the beveled edge (i.e., a stopper effect). The Vogt patent also requires the pull tab extension 17 which adversely effects the cost-effectiveness of this design.

SUMMARY OF THE INVENTION

It is an object of the present invention to provide a less costly easy-opening top closure member for a beverage or other container.

It is a further object of the present invention to provide an easy-opening closure member for a beverage container that is partially closeable after opening.

It is a further object of the present invention to provide an easy-opening top closure member for a beverage container that is safe and efficient.

It is a further object of the present invention to provide an easy-opening top closure member that is less expensive to manufacture.

It is a further object of the present invention to provide an easy-opening top closure member for a beverage container that will not break off or go into the can or be consumed with the beverage from the can.

It is a further object of the present invention to provide an easy-opening top closure member that may be opened and then partially reclosed by slight finger pressure of the user.

The above objects are achieved with a container having an improved container closure according to the present invention. The container closure of the present invention includes a container end wall having an opening therethrough, a tab pivotably attached to the end wall, a hinge pivotably connecting the tab to the end wall, and an adhesive backed tape attached to the undersurface of the tab. When the tab is in the original closed position, the tab is spaced from the end wall at the perimeter thereof, except at the hinge. Additionally, the tab is aligned with the end wall in the original closed position. The tape is releasably attached to the end wall around the opening when the tab is in the original closed position to seal the opening of said end wall. The portion of the tape sealing the opening is adapted to be released from the end wall when the tab is moved to the open position.

The presently claimed invention avoids the difficulties of the prior art such as the Gnyp patent. In the present invention, the tape is attached to the tab and releasably secured to the end wall around the opening. The releasable connection results in the tape peeling away from engagement with the end wall without tearing. The tab does not have to be specially shaped and the tape does not have to be scored.

In summary, the present invention provides a tab that is spaced from the end wall in the original closed position by a portion of the perimeter, specifically, the portion of the perimeter of the tab other than the hinge. The present invention utilizes the tape to seal the opening when the tab is in the original closed position.

BRIEF DESCRIPTION OF THE DRAWINGS

FIG. 5 is a side view, partially in section, of the beverage container shown in FIG. 4;

FIG. 6 is a perspective view of the end wall region of the beverage container shown in FIG. 4.

DETAILED DESCRIPTION OF THE DRAWINGS

Figure 1:
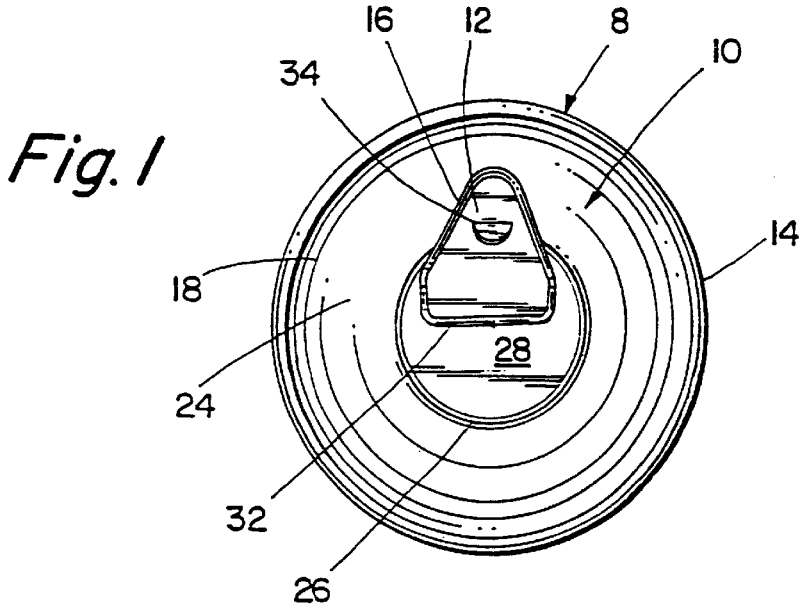
FIG. 1 is a plan view of an end wall and closure of a beverage container according to the present invention.
Figure 7:
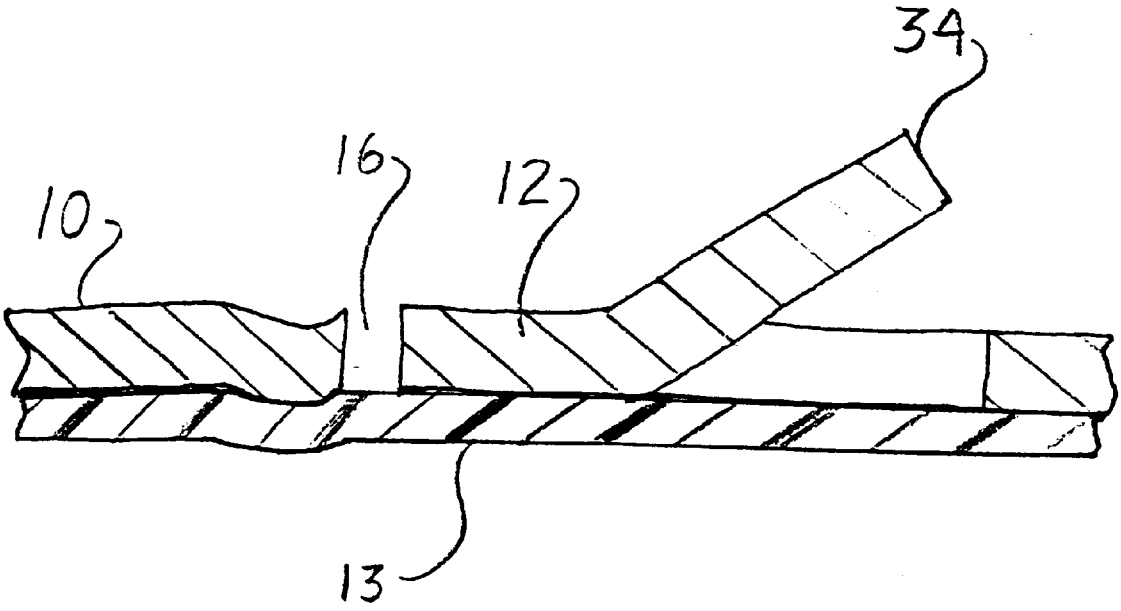
FIG. 7 is an enlarged view of the end wall shown in FIG. 3.

What is shown in FIG. 1 is an end wall or lid 10 of a beverage container 8 wherein the end wall or lid 10 has a push tab 12 that is used to open the beverage container 8 so that the beverage contained therein may be consumed. The outer perimeter or side wall 14 of the beverage container 8 joins with the end wall or lid 10. There is a region of predetermined separation 16 that extends part of the way around push tab 12 and ends where push tab 12 attaches to end wall or lid 10 at hinged section 32. The predetermined separation 16 is a cut or score line which extends completely through the end wall 10 such that the push tab 12 is spaced from the end wall 10 and aligned with the end wall 10 when the push tab is in the original closed position as better shown in FIG. 7. Preferably the separation 16 is made substantially perpendicular to the plane of the lid 10 for ease of manufacture. If the separation 16 were beveled, the bevel should allow for the tab 12 to be easily pushed through the opening. Referring again to FIGS. 1–6, annular surface 24 rises from recession 18 to form annular ridge 26 that surrounds and forms the inner level region 28 of the end wall 10. Tab 12 is formed in a part of the raised region shown at 28 may be pressed downward using a finger so as to detach the tab 12 from the end wall 10 by pivoting about the hinged section 32. The tab 12 can then be partially closed, but not sealed, by lifting tab 12 upward with a fingernail at fingernail slot or gripping member 34 when so desired. Additionally, it is possible to pull the tab 12 up through the opening to move the tab 12 out of the user's way.

Figure 2:
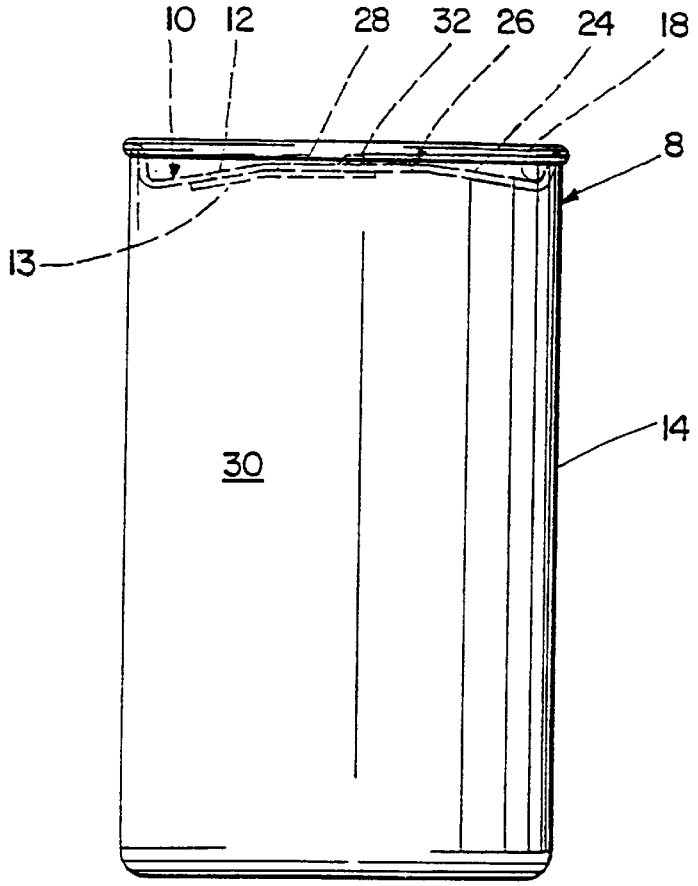
FIG. 2 is a side view of the end wall region of the beverage container shown in FIG. 1.

FIG. 2 shows the end wall region 10 with the outer boundary 14 forming a beverage container 8 with a beverage 30 shown contained within the side walls 14 of the beverage container 8. A tab 12 is shown by a double dotted line having a raised region in the area of 28. Shown also in FIG. 2 is the annular surface 24 that rises from the recession 18 to meet the annular ridge 26 to form the center level portion 28. Below the separable tab 12 is a beverage compatible and consumer safe tape 13 that attaches to the undersurface of tab 12 between tab 12 and the beverage 30 and also attaches to the undersurface of end wall 10 between the end wall 10 and the beverage 30. The tape 13 seals the predetermined separation between the tab 12 and the end 10 when the tab 12 is in this position.

Figure 3:
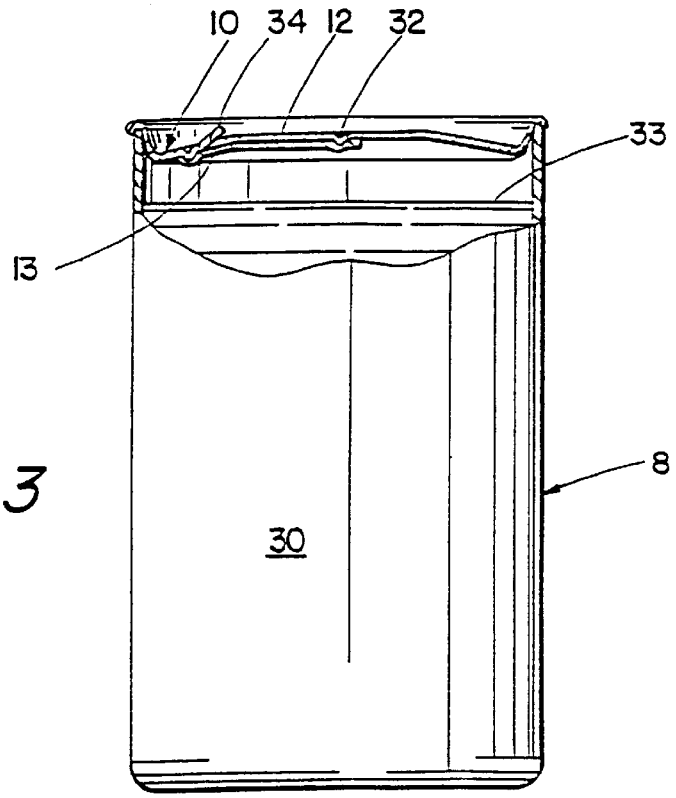
FIG. 3 is a side view, partially in section, of the end wall of the beverage container shown in FIG. 1.

What is shown in FIG. 3 is a side end view of the beverage container 8. The tab 12 is shown attached to the end wall region 10 of the beverage container 8 at hinged section 32 having a beverage 30 contained therein with a level of beverage shown at 33. Tape 13 is shown attached to the undersurfaces of tab 12 and end wall 10 sealing the predetermined separation 16 or space between tab 12 and end wall 10 and thereby containing beverage 30 within beverage container 8.

Figure 4:
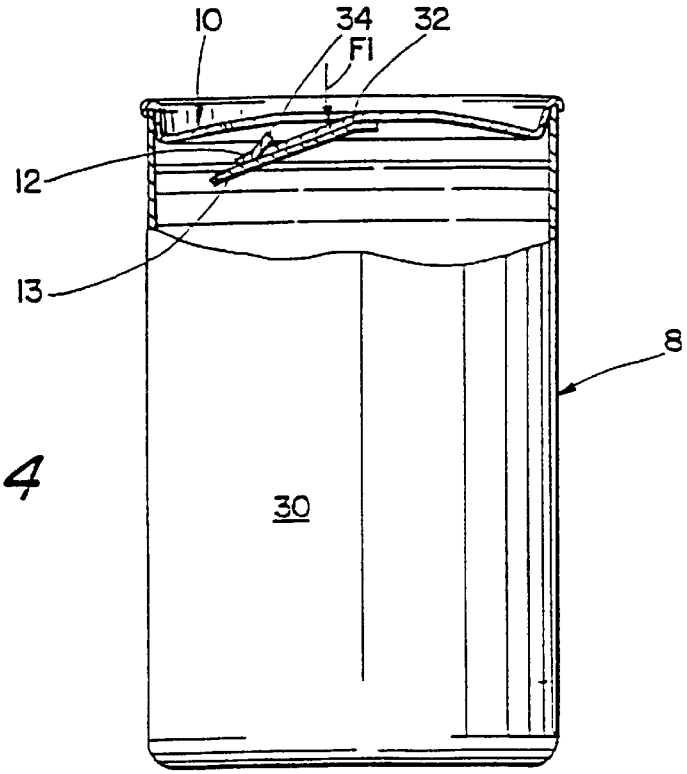
FIG. 4 is a side view, partially in section, of the end wall region of the beverage container according to the present invention with the closure in the open position.

What is shown in FIG. 4 is the tab 12 after it has been separated from the end wall region 10 by a slight finger pressure downward depicted by arrow F1 with the tape 13 no longer attached to the undersurface of the end wall region 10 between the end wall 10 and the beverage 30 except at hinged section 32 which is not detachable. The tape 13 is still attached to the undersurface of the tab 12 and is in a position such that the tape 13 extends laterally outward from the tab 12 so that if the tab 12 were lifted upwards into its pre-detached position with the end wall 10 by using a fingernail at fingernail slot 34, the tab 12 would partially close, but not seal, the beverage container 8.

What is shown in FIG. 5 is the end wall region 10 of an easy-opening beverage container 8 with beverage 30 therein, with the end wall region 10 having a tab 12 that is attached to a hinged section 32 for opening with tab 12 and partially closing with fingernail slot 34. Beneath tab 12 is an adhesive tape 13 that fastens to the undersurface of the end wall 10 and seals the predetermined separation between end wall 10 and the tab 12 prior to opening. When pressing down on the tab 12 with slight finger pressure depicted by F1, the hinged section 32 allows tab 12 to be bent downward forcing the tape 13 away from the undersurface of the end wall 10 and creating an opening 42 in the end wall region 10 so that the beverage 30 may be poured though the opening 42. There is a rounded edge 36 that is formed on the upper ridge created by the recessed tab 12 from the end wall region 10. This rounded edge 36 is for safety reasons to reduce the possibility of finger, mouth, or lip injury when opening or closing the tab 12, or consuming the beverage 30.

What is shown in FIG. 6 presents a more clear definition of the end wall region 10 of the container 8 wherein tab 12 has a separation edge 40 and is joined to the hinged section 32 of the end wall region 10. The tab 12 is recessed into the end wall region 10 with top ridge 36 rounded above the separation edge at 38 of the end wall region 10. Tape 13 remains attached to the undersurface of the tab 12, but detaches from the undersurface of the end wall 10 when tab 12 is pushed downward into container 8 by a slight finger pressure. By lifting upward tab 12 at slot 34 with a fingernail, tab 12 would partially close, but not seal, the beverage container 8.

It will readily be appreciated by those skilled in the art that modifications may be made to the invention without departing from the concepts disclosed in the foregoing description. For example, the tab 12 may be formed with an opening therethrough sized to accommodate a standard drinking straw. In such a modification the container may be opened by having the straw pierce the tape 13 while leaving the tab 12 in the original closed position. Such modifications are to be considered as included within the scope of the invention. Accordingly, the particular embodiments described in detail hereinabove are illustrative only and are not limiting as to the scope of the invention, which is to be given the full breadth of the appended claims and any and all equivalents thereof.

What is claimed is:

1. A container closure comprising:

a container end wall having an opening therethrough;

a tab pivotably attached to said end wall along a first portion of a perimeter of said tab, said tab moveable between an original closed position and an open position extending into an interior of the container, said tab substantially covering said opening of said end wall when in said original closed position, and said tab is spaced from said end wall along a second portion of said perimeter and said perimeter of said tab is aligned with said end wall when said tab is in said original closed position;

a hinge pivotably connecting said tab to said end wall along said first portion of said perimeter of said tab; and an adhesive backed tape attached to said tab, said tape attached to said end wall at least when said tab is in said original closed position, wherein at least a portion of said tape extends around said second portion of said perimeter and releasably attached to said end wall to seal said opening of said end wall when said tab is in said original closed position, said portion of said tape around said second portion of said perimeter of said tab adapted to be released from said end wall adjacent said second portion when said tab is moved to said open position.

2. The closure of claim 1 wherein said second portion of said perimeter extends from one end of said hinge to an opposite end of said hinge, and wherein said first portion of said perimeter is the only portion of said tab attached directly to said end wall when said tab is in said original closed position.

3. The closure of claim 1 wherein said tape extends around the entire of said perimeter of said tab, and wherein said tape reinforces said hinge and prevents said hinge from separating from said end wall.

4. The closure of claim 1 wherein said tab includes a portion extending upwardly therefrom to form a gripping member on said tab, wherein said gripping member is adapted to be engaged by the user to pivot said tab to a secondary closed position.

5. The closure of claim 4 wherein said tab has a slot therethrough adjacent said gripping member, wherein said slot is sealed by said tape at least when said tab is in said original closed position.

6. The closure of claim 1 wherein said tab has a slot therethrough, wherein said slot is sealed by said tape at least when said tab is in said original closed position.

7. The closure of claim 1 wherein a portion of said end wall containing said opening is raised relative to an outer perimeter of said end wall.

8. The closure of claim 1 wherein a perimeter of said end wall around said opening is rounded.

9. The closure of claim 1 wherein a portion of said end wall containing said opening is raised relative to an outer perimeter of said end wall, and wherein a perimeter of said end wall around said opening is rounded.

10. A container comprising:

a body having a base and a side wall defining a container interior;

a container end wall attached to said side wall and having an opening therethrough extending into said container interior;

a tab pivotably attached to said end wall along a first portion of a perimeter of said tab, said tab moveable from an original closed position to an open position within said container interior, said tab substantially covering said opening of said end wall when in said original closed position, and said tab is spaced from said end wall along a second portion of said perimeter and said perimeter of said tab is aligned with said end wall when said tab is in said original closed position;

a hinge pivotably connecting said tab to said end wall along said first portion of said perimeter of said tab; and an adhesive backed tape attached to an undersurface of said tab, said tape attached to said end wall at least when said tab is in said original closed position, wherein said tape extends at least around said second portion of said perimeter and releasably connected to said end wall when said tab is in said original closed position to seal said opening of said end wall when said tab is in said original closed position, wherein pressure within said interior of said container acts to additionally hold said tab in said original closed position, and wherein at least a portion of said tape will be released from said end wall when said tab is moved to said open position.

11. The container of claim 10 wherein said second portion of said perimeter extends from one end of said hinge to an opposite end of said hinge wherein said first portion of said perimeter is the only portion of said tab attached directly to said end wall when said tab is in said original closed position.

12. The container of claim 10 wherein said tape extends around the entire of said perimeter of said tab wherein said tape reinforces said hinge and said tape is maintained as a one-piece integral member throughout movement of said tab.

13. The container of claim 10 wherein said tab includes a portion extending upwardly therefrom to form a gripping member on said tab, wherein said gripping member is adapted to be engaged by the user to pivot said tab to a secondary closed position.

14. The container of claim 13 wherein said tab has a slot therethrough adjacent said gripping member, wherein said slot is sealed by said tape at least when said tab is in said original closed position.

15. The container of claim 10 wherein a portion of said end wall containing said opening is raised relative to an outer perimeter of said end wall.

16. The container of claim 10 wherein a perimeter of s aid end wall around said opening is rounded.

17. A beverage container comprising:

a metallic body having a circular base and a cylindrical side wall defining a container interior adapted to hold a beverage;

a container end wall attached to said side wall a n d having an opening therethrough extending into said container interior;

a metallic tab pivotably attached to said end wall along a first portion of a perimeter of said tab, said tab moveable from an original closed position to an open position within said container interior, said tab substantially covering said opening of said end wall when in said original closed position, and said tab is spaced from said end wall along a n entire remaining portion of said perimeter and said perimeter of said tab is aligned with said end wall when said tab is in said original closed position;

a hinge pivotably connecting said tab to said end wall along said first portion of said perimeter of said tab; and an adhesive backed tape attached to said tab, said tape attached to said end wall at least when said tab is in said original closed position, wherein said tape extends around said entire perimeter of said tab and adapted to seal said opening when said tab is in said original closed position, and wherein pressure within said interior of said container acts to hold said tab in said original closed position and said tape in a sealing position along with the adhesive of said tape, and wherein said tape is released from engaging a portion of said end wall when said tab is moved to said open position.

18. The container of claim 17 wherein said tab includes a portion extending upwardly therefrom to form a gripping member on said tab, wherein said gripping member is adapted to be engaged by the user to pivot said tab to a secondary closed position.

19. The container of claim 18 wherein said tab has a slot therethrough adjacent said gripping member, wherein said slot is sealed by said tape.

* * * * *